US005894457A

United States Patent [19]

Lüth

[11] Patent Number: 5,894,457

[45] Date of Patent: Apr. 13, 1999

[54] WATCH FOR SOCCER REFEREES

[76] Inventor: Alexander Lüth, Friedrichstrasse 7, D-99894, Friedrichroda, Germany

[21] Appl. No.: 08/750,779

[22] PCT Filed: Jun. 22, 1995

[86] PCT No.: PCT/DE95/00785

§ 371 Date: May 9, 1997

§ 102(e) Date: May 9, 1997

[87] PCT Pub. No.: WO95/35556

PCT Pub. Date: Dec. 28, 1995

[30] Foreign Application Priority Data

Jun. 22, 1994 [DE] Germany ..... 94 09 849 U

[51] Int. Cl.[6] ..... G04F 8/00

[52] U.S. Cl. ..... 368/108; 368/223

[58] Field of Search ..... 368/223–232, 368/107–113

[56] References Cited

U.S. PATENT DOCUMENTS 3,864,904 2/1975 Jung ..... 368/109

4,006,588 2/1977 McMahon et al. ..... 368/233

4,945,522 7/1990 Radel ..... 368/77

*Primary Examiner*—Bernard Roskoski

*Attorney, Agent, or Firm*—Armstrong, Westerman, Hattori, McLeland & Naughton

[57] ABSTRACT

The invention relates to a football referee's watch, preferably a wristwatch, for the analog display of the playing and extra time when a game is prolonged (to make up interruptions in play) with a dial (1) to indicate the playing time divided into minutes, having a sector shaped section (4), preferably between the 45th and 60th minutes and with a rotary signal disc (2) arranged centrally beneath it to show the extra time which, when inoperative, also has a distinctive colour, a minute hand (3) above the dial (1), in which said analog displays (2,3) are operated by separate motors (M1, M2) and the display is controlled by an electronic circuit (E1) depending on the operation of various keys (T1,T2,T3, T4,T5,T6) with start, stop and special functions.

10 Claims, 2 Drawing Sheets

WATCH FOR SOCCER REFEREES

Figure 1:
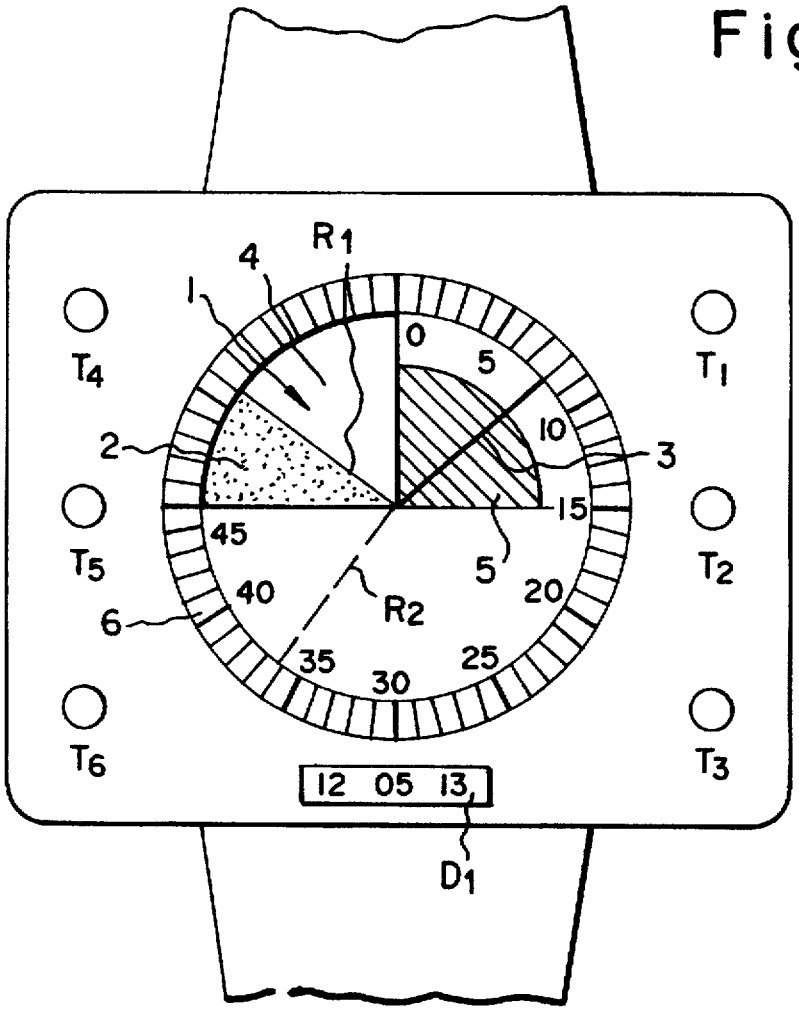

The invention relates to a soccer referees, especially a wrist-watch, with a dial plate with a minute scale, an electronic circuit, with a motor drive and a gear for driving analogous displays.

Since the last Soccer World Championship in the United States in 1994 the soccer referees have been adviced to punish arbitrarily extended game-interruptions, breaks, time-outs or the like by the one or the other team (for instance before free kicks or the like) by extension of the effective play-time by a respective injury time after lapsing of the regular play-time. It happened at those times that a game-half-time half-time has been extended nearly by a quarter of an hour. The soccer referees on their behalf had to determine such game-prolongations only by a simple stop-watch, as they had no other proper watches. Subject of the German Patent 42 05 585 discloses a watch for sport competitions with a couple of display surfaces, control means and a motor for driving the analogous display. One of said display surfaces is a centrically rotating signal disc for showing the time of the day, whereby circle sectors of different size are going to show the time of the day. This watch also comprises start and stop activation elements. Measure values (for instance temperature and time) are analogously represented without using any hands and scales. A determination and/or recording of game interruptions for determining the amount of all time-outs to be played as "injury time" after the regular play time is not possible with that device.

Subject of the German Patent Application 24 11 799 is a wrist-watch for showing the time of the day, whose display surface comprises a recess, through which a lower display surface provided with coloured sectors can be watched.

The U.S. Pat. 2,183,548 discloses an indicator for notifying the times of sport competitions comprising a couple of forwardly and backwardly running motors for driving the display elements.

The German Patent Application 39 18 480 discloses display devices for the normal course of the day symbolized by coaxially rotating surfaces. The purpose of those devices is that specified times of the day shall be efficiently re-presented by discs being arranged as segments and being rotated. These are design-watches missing hour- and minute-hands but showing other solutions. The combined representation of courses of the time with segment discs and watch-hands are not mentioned in this disclosure.

The subject of the German Patent Application 36 39 814 is a start chronometer for races, especially boat-races, whereby an only hand is moving with different speeds over certain marked sectors of a dial-plate. A determination of longer game interruptions provoced by players as happening sometimes during soccer games is not possible with this chronometer. A respective time to be played after the regular play-time (injury time) can not be determined or recorded with this watch.

The subject of the German Patent Application 39 40 326 finally shows "means for representing measured values". These are segment discs or full discs with marks, changeable colour effects or imprints moving in front of a scale disc. The task being fulfilled by a soccer referee watch, namely to determine, to record and to show the regular play-half-time as well as the game interruptions for being able to display the total play-time for compensating the game interruptions, is not specified or solved in this disclosure.

It is therefore an object of this invention to provide a watch for soccer referees of the type mentioned above which enables the soccer referee to determine the injury time very simply, quickly and precisely and to make the same visible for the user.

This object will be solved according to the invention by the items and features characterized in claim 1. Inventive improvements and advantageous arrangements are disclosed in the sub-claims.

By means of the inventive watch, especially by the coloured (for instance red) identified signal disc will be reached that the referee can always watch and check the length of one or more game-interruptions having been precisely recorded by himself during a regular game-halftime. He can also check the still remaining play-time (remaining regular play-time including the injury time) and objectively determine the injury time to be added to the regular play-halftime.

The same is the case for the extra times of games.

Figure 2:
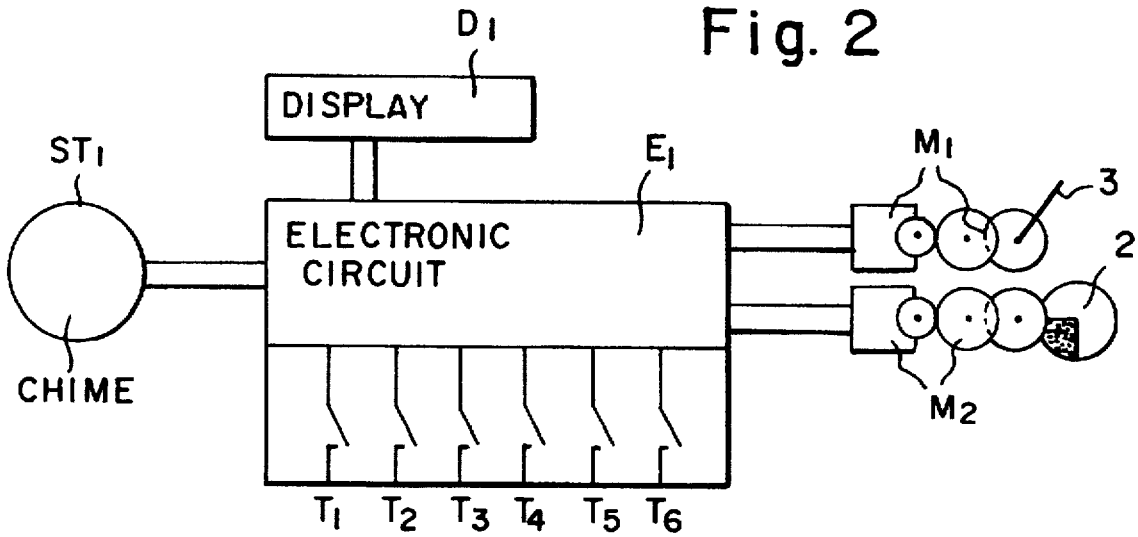
Figure 3:
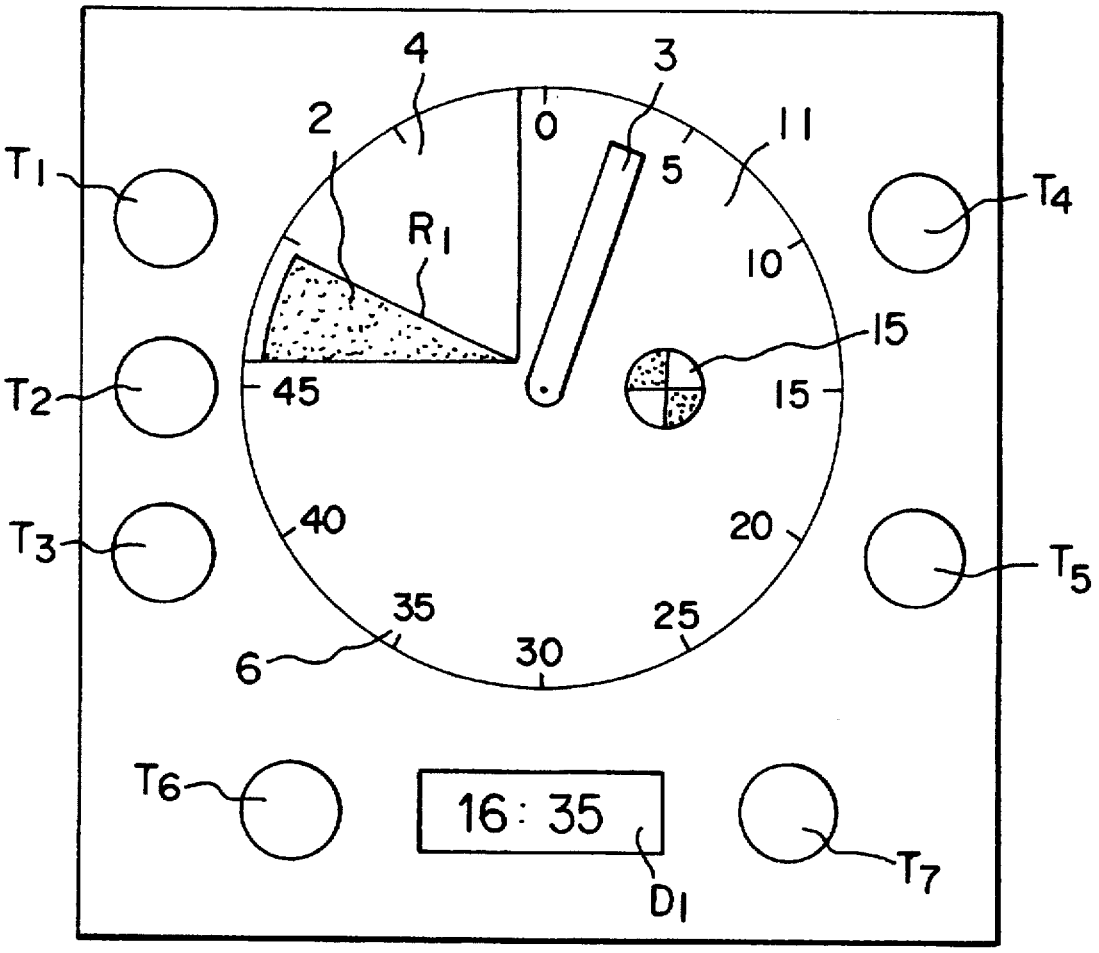

Preferred embodiments of the invention will be explained by means of the enclosed drawings. It will be shown in:

FIG. 1 a front view of the inventive soccer referee watch;

FIG. 2 an electronic circuit for controlling a referee watch according to the invention and in FIG. 3 a front view of a modified embodiment of an inventive referee watch with a different arrangement of the control keys.

FIG.1 shows a watch for referees according to the invention with a dial plate provided with a minute scale 6. The sector between the 45th and 60th minute (of the dial plate 1) is provided with a recess 4. The sector between the 0th and 15th minute (of the dial plate 1) is provided with a coloured (for instance yellow) imprint 5 for identifying and for improving the visibility of the duration of a 15-minute-play-halftime.

The watch comprises further a minute hand 3 for indicating the regular play-halftime (45 minutes) and the regular extra time (15 minutes) as well as a signal disc 2 arranged below the dial plate 1. The signal disc 2 is (in its starting position at the beginning of the game) coloured (for instance red) in the sector between the 30th and the 45th minute (between the sector radiuses $R_1$ and $R_2$). The remaining sector surface between (clockwise) the 45th and 30th minute is coloured grey.

In or at the housing of the inventive watch following parts are provided according to FIG. 1:

- a motor $M_1$ for driving the minute hand 3;
- a motor $M_2$ for driving the signal disc 2;
- an electronic circuit $E_1$ (controlled by a micro processor);
- a tone generator (buzzer) $ST_1$ generating a signal tone;
- a watch display $D_1$ for showing the normal time of the day;
- a key $T_1$ to be pressed at the beginning of a regular game-half-time (45 minutes);
- a key $T_2$ to be pressed at the end of a regular game-half-time (45 minutes);
- a key $T_3$ for separately switching off the tone generator $ST_1$;
- a key $T_4$ to be pressed at the beginning of a game-interruption during a regular game-halftime (45 or 15 minutes);
- a key $T_5$ to be pressed at the end of a game-interruption during a regular game-halftime (45 or 15 minutes) and
- a key $T_6$ for setting the watch in case of a regular extra time (by twice 15 minutes).

The mode of operation of the inventive watch and the functions of the keys $T_1$, $T_2$, $T_3$, $T_4$, $T_5$ and $T_6$ provided thereto will be precisely explained as follows:

At the beginning of a regular game-halftime (45 minutes) key $T_1$ will be pressed. Consequently motor $M_1$ will be switched on by the electronic circuit $E_1$ (being controlled by a micro processor) and will drive the minute hand 3 through an intermediate gear in minute speed. After the minute hand 3 has reached the 45th minute on the minute scale 6 the electronic circuit $E_1$ will be activated for automatically switching on the tone generator $ST_1$ for delivering a signal tone and the minute hand 3 will stop.

At the end of a regular game-halftime (45 or 15 minutes) key $T_2$ will be pressed. Thereby the function of key $T_1$ will be cancelled, the tone generator $ST_1$ stops sounding and the motor $M_1$ will be switched to run backwards. Thereby the minute hand 3 will be reset backwardly in a fast-run to its zero-stop (into its start position). At the same time also the signal disc 2 will be reset into its start position.

Thereby the sector radius $R_1$ (defining the red sector of the signal disc 2) will be positioned at the 45th minute of the minute scale 6 (at the rim of the recess 4 of the dial plate 1). After that the watch is ready for its next use.

By pressing the key T3 the tone generator $ST_1$ can be switched off separately. Thereby the current supply to the tone generator $ST_1$ will be cut by the electronic circuit $E_1$.

The injury time (due to one or more longer game-interruptions) to be added at the end of a regular game-halftime will be determined and recorded by means of the inventive watch as follows:

At the beginning of a longer game-interruption of a game-halftime the referee will press the key $T_4$. Hereby the circuit $E_1$ will switch on the motor $M_2$ which drives the signal disc 2 forwardly through an intermediate gear in minute speed, so that the red sector of the signal disc 2 will become visible in the recess 4 of the dial plate 1. The position for the sector radius $R_1$ with respect to the adjacent minute scale 6 will respectively indicate the total length of the injury time due to game-interruption(s).

Example: In case that the sector radius $R_1$ at the minute scale 6 of the dial plate 1 should be positioned at the 51st minute (according to FIG.1), the injury time to be added to the regular game-halftime will be 6 minutes.

In case that the game-interruption has been ended key $T_5$ will be pressed. Circuit $E_1$ will interrupt the current supply to the motor $M_2$, and the signal disc 2 will stop.

This procedure can be repeated during a game-halftime up to a total injury time of maximum 15 minutes. The minute hand 3 will run forwards independently from pressing the keys $T_4$ and $T_5$ (also during a game-interruption).

In case that the minute hand 3 has reached the 45th minute at the end of the regular game-halftime, the regular game-halftime halftime will—without any further interruption—be automatically extended by the injury time (recorded during the regular game-halftime).

For this reason motor $M_2$ will be switched by the circuit $E_1$ to run automatically backwards. Motor $M_2$ will turn the signal disc 2 (counter-clockwise) so far backwards until the sector radius $R_1$ of the red sector of the signal disc 2 will be at the 45th minute of the minute scale 6 of the dial plate 1, whereby the red sector of the signal disc 2 is not visible any more.

In case the sector radius $R_1$ of the red sector of the signal disc 2 should have reached the 45th minute at the minute scale 6 a signal tone will automatically be released by the tone generator $ST_1$. On pressing key $T_2$ the tone generator $ST_1$ will be switched off by circuit $E_1$. The minute hand 3 will run backwards to its starting position.

In case a game-interruption should occur during the injury time key $T_4$ has to be pressed. Thereby the backward-move of the signal disc 2 will be interrupted. Signal disc 2 will stop and will continue its backsward-move only after the end of the game-interruption will be confirmed by pressing key $T_5$. Thereby longer game-interruptions can be considered also during the injury time.

In case of a drawn game-score (for instance 1:1 or 2:2) an extension of the game by an extra time by twice 15 minutes should be necessary, key $T_6$ has to be pressed. Thereby the end of the regular play-time will be set by the 15th minute by means of circuit $E_1$. The measurement of time will happen analogously to the above-said description of the procedures at the regular soccer-halftime of 45 minutes length.

As shown in FIG. 1 the inventive watch is provided with an independently settable time of the day display $D_1$ for indicating the regular time of the day. The inventive watch will preferably be produced as a liquid crystal watch.

In FIG. 3 a front view of a modified soccer referee watch is shown. Hereby the dial plate 11 will comprise a decentrally positioned second display. The arrangement of this row of keys will differ from the arrangement of the keys at the watch according to FIG. 1. The keys will respectively perform, when pressed, the following functions:

$T_1$: Begin of the game $T_2$: End of the game $T_3$: Extension by 15 minutes $T_4$: Break of the game (begin)

$T_5$: Break of the game (end)

$T_6$: Forward-move of the watch $T_7$: Backward-move of the watch

For student and junior soccer games having shorter half-times (with less than 45 minutes) the design of the inventive referee watch has to be fit to the respective shorter play-time being valid fur students and juniors.

I claim:

1. A watch for soccer referees for analogous display of regular play-time, extension of play-time and injury time of soccer games, the watch comprising:

a dial plate having a minute scale and a circle-sector-formed recess between 45th and 60th minute sections on the dial plate;

a signal disc centrally and rotatingly disposed under the dial plate for indicating an injury time, the signal disc having a resting position with another colored imprint; and a minute hand above the dial plate, wherein the signal disc and the minute hand are driven by separate first and second motors and are activated by an electronic circuit; and key,s having at least a start function and a stop function, which when pressed, operate the electronic circuit.

2. The watch for soccer referees according to claim 1, wherein the signal disc, when seen at a starting position thereof at the beginning of the game between a 30th and 45th minute red colored section and between a clockwise 45th and 30th minute grey colored section on the dial plate and if an injury time should occur by pressing a fourth of the keys, the red sector becomes visible within the recess of the dial plate.

3. The watch for soccer referees according to claim 1 or 2, wherein the recess between the 45th and 60th minute section is provided with a red or yellow colored printed surface between a 0th and 15th minute section.

4. The watch for soccer referees according to claim 1 or 2, wherein the minute hand is started by pressing a first key of the keys for key activating the first motor by means of the electronic circuit and is automatically stopped by the electronic circuit after a lapse of 45 minutes.

5. The watch for soccer referees according to claim 1 or 2, wherein a forward-move of the signal disc is started by pressing a fourth key of the keys to activate the second motor by means of the electronic circuit, and is stopped by pressing a fifth key of the keys, and wherein the second motor activated by the electronic circuit drives the signal disc backwardly, after the minute hand has reached its 45th minute position.

6. The watch for soccer referees according to claim 1 or 2, wherein the first motor is activated by pressing the second key and by means of the electronic circuit, quickly turns the minute hand forwardly into its 0th minute starting position, whereby the signal disc moves backwardly into its 45th minute starting position.

7. The watch for soccer referees according to claim 1 or 2, wherein the minute hand is started by pressing a sixth key of the keys by means of the electronic circuit to activate the first motor, and is automatically stopped by the electronic circuit after 15 minutes.

8. The watch for soccer referees according to claim 1 or 2, further comprising a separate signal tone generator for generating a signal tone by means of the electronic circuit if the minute hand has reached its 45th or 15th minute position and the signal disc has reached its 45th minute position, and wherein the signal tone generator can be separately deactivated by pressing a third key of the keys by means of the electronic circuit.

9. The watch for soccer referees according to claim 1 or 2, further comprising a watch housing with a separate liquid crystal display for indicating the normal time of the day.

10. The watch for soccer referees according to claim 1 or 2, further comprising a band so as to function as a wristwatch.

* * * * *